US011458339B2

(12) United States Patent
Shih

(10) Patent No.: US 11,458,339 B2
(45) Date of Patent: Oct. 4, 2022

(54) HOT MELT SAFELY DOOR HOLDER DEVICE

(71) Applicant: CHO ROON DEVELOPING ENTERPRISE CO., LTD., Taichung (TW)

(72) Inventor: Jing-Teng Shih, Taichung (TW)

( * ) Notice: Subject to any disclaimer, the term of this patent is extended or adjusted under 35 U.S.C. 154(b) by 668 days.

(21) Appl. No.: 16/275,610

(22) Filed: Feb. 14, 2019

(65) Prior Publication Data

US 2020/0261754 A1 Aug. 20, 2020

(51) Int. Cl.
*A62C 2/24* (2006.01)
*E05C 17/56* (2006.01)

(52) U.S. Cl.
CPC ..... *A62C 2/241* (2013.01); *E05C 17/56* (2013.01)

(58) Field of Classification Search
CPC .... Y10T 292/11; Y10T 292/34; Y10T 292/37; A62C 2/241; E05C 17/56; E05C 19/16; E05C 19/161; E05C 19/163; E05C 19/18; E05C 19/184; Y10S 292/15; Y10S 292/19; Y10S 292/38; Y10S 292/65; E05B 2063/0091; E05B 47/0009; E05B 47/0038; E05B 47/0046
USPC ..... 49/7
See application file for complete search history.

(56) References Cited

U.S. PATENT DOCUMENTS 717,813 A * 1/1903 Colman ..... E05C 19/063 292/17
1,953,582 A * 4/1934 Belknap ..... A62C 37/12 169/42
2,764,025 A * 9/1956 Otto ..... H01H 37/76 74/2
3,244,443 A * 4/1966 Rodgers ..... E05C 17/56 292/251.5
3,261,631 A * 7/1966 Alessi ..... E05C 17/56 292/251.5
3,744,832 A * 7/1973 Casey ..... E05F 1/002 292/101

(Continued)

FOREIGN PATENT DOCUMENTS

EP 1162334 A1 * 12/2001 ..... E05B 15/102
FR 2790673 A1 * 9/2000 ..... F16K 17/383
TW M531503 U 11/2016

*Primary Examiner* — Christine M Mills
*Assistant Examiner* — Steven A Tullia
(74) *Attorney, Agent, or Firm* — Egbert, McDaniel & Swartz, PLLC

(57) ABSTRACT

A hot melt safety door holder device includes: a first fixing part on one side of swing end of swing door sheet; a holder with a transverse through hole and the outer hole end faces towards the first fixing part; a second fixing part in the transverse through hole, the first radial end faces towards the outer hole end of transverse through hole, the second radial end faces towards the inner hole end; a conically cylindrical space, formed between the periphery of the second fixing part and the transverse through hole, and the inside and outside diameters of the end between the transverse through hole and the second fixing part corresponding to the space tapering end of conically cylindrical space are fitted with each other. The shape of the low-melting metal material filled in the conically cylindrical space matches the shape of conically cylindrical space, resulting in equal wall thickness.

9 Claims, 12 Drawing Sheets

(56) References Cited

U.S. PATENT DOCUMENTS 4,099,292 A * 7/1978 McCabe ..... A62C 37/16 16/48.5
4,161,804 A * 7/1979 D'Hooge ..... A62C 2/12 16/48.5
4,191,412 A * 3/1980 LeKander ..... A62C 2/16 292/182
4,232,796 A * 11/1980 Hudson, Jr. ..... F16K 17/383 137/72
4,505,502 A * 3/1985 Tomita ..... E05C 17/56 16/320
4,627,498 A * 12/1986 Aalto ..... A62C 2/242 126/287.5
4,835,904 A * 6/1989 Secco ..... A62C 2/242 49/1
5,380,053 A * 1/1995 Saino ..... E05B 65/104 292/144
5,527,074 A * 6/1996 Yeh ..... E05B 65/104 292/177
5,836,049 A * 11/1998 Chiang ..... E05C 17/50 16/82
5,944,368 A * 8/1999 Hastings ..... E05C 17/56 292/251.5
6,318,399 B1 * 11/2001 Backham ..... A62C 2/16 137/601.15
6,725,602 B1 * 4/2004 McWilliams ..... E06B 3/365 49/31
7,393,027 B1 * 7/2008 Chen ..... E05C 17/56 16/82
7,530,891 B2 * 5/2009 Perrin ..... A62C 2/12 454/369
8,132,833 B2 * 3/2012 Schnekenburger .... G08B 17/06 292/341.16
2007/0113376 A1 * 5/2007 Frushour ..... E05F 5/06 16/83

* cited by examiner

HOT MELT SAFELY DOOR HOLDER DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a door holder device, and more particularly to the innovative structure type of a hot melt safety door holder device.

2. Description of Related Art Including Information Disclosed Under 37 CFR 1.97 and 37 CFR 1.98

At present, the commercially available door holder devices, according to their door fixing structure types, are approximately divided into magnetic attraction and snap-in fixing types.

In recent years, considering the fire prevention requirements, relevant circles developed a hot melt safety door holder device, in the case of fire, a low-melting metal located in the fixing part can be molten by the high temperature instantly to release the door body, the door body turns into closed state automatically, so as to implement the fire safety effect on obstructing the flame and dense smoke spread. The known patent technology can be seen in M531503 "fireproof door holder" Taiwanese utility model of Nov. 1, 2016.

However, there are some problems and defects in the practical application of the structure type of said known hot melt safety door holder device. For example, the low-melting metal located in the snapping part of the known hot melt safety door holder device is a straight tube filled in the annular clearance formed between the straight tubular internal groove sidewall of an outer holder and the straight tubular peripheral wall of a positioning component (e.g. magnet, fastener), and the low-melting metal tube wall thickness must be lower than a certain level (e.g. several millimeters), so that it can melt instantly in a fire. However, in the course of filling the low-melting metal between the straight tubular internal groove sidewall of outer holder and the straight tubular peripheral wall of positioning component, it is difficult to locate the position of positioning component opposite to the straight tubular internal groove sidewall of outer holder in concentric circle accurately. Therefore, sometimes after the low-melting metal is formed and solidified, the lateral tube walls have uneven thickness, leading to inconsistent melting point of lateral tube walls, difficult estimation of overall melting temperature of low-melting metal and poor quality performance.

In addition, the hot melt safety door holder device is usually installed on one side of the swing end of door sheet, so when the low-melting metal is molten, the path on which the positioning component leaves the internal groove sidewall of outer holder as the door sheet swings open is a cambered path instead of a straight line. Thus, when the straight tubular peripheral wall of the positioning component is escaping, the original parallel relationship between its alignment line and the alignment line of the straight tubular internal groove sidewall of outer holder turns into interlaced relationship, so that the positioning component is likely to be stuck in the straight tubular internal groove sidewall of outer holder, failing to escape smoothly, and the door body cannot be closed automatically.

Industry could probably enlarge the cross-section area of the annular clearance between the straight tubular internal groove sidewall of outer holder and the straight tubular peripheral wall of positioning component, so that the straight tubular peripheral wall of positioning component can avoid rubbing the straight tubular internal groove sidewall of outer holder when escaping. Thus, the low-melting metal tube wall thickness is multiplied, the hot melt acuity and defect are reduced greatly. This is an important technical topic the relevant circles shall pay attention to.

BRIEF SUMMARY OF THE INVENTION

The primary object of the present invention is to provide a hot melt safety door holder device. The technical problem to be solved is to break through how to develop a new type of hot melt safety door holder device with more ideal practicability.

Based on said purpose, the technical characteristic of problem solving of the present invention is that said hot melt safety door holder device comprises a first fixing part, which is located on one side of the swing end of a swing door sheet; a holder with a mounting part and a transverse through hole located in different positions, the transverse through hole has an outer hole end and an inner hole end, the outer hole end faces towards the first fixing part; a second fixing part located in the transverse through hole of holder, the second fixing part has a first radial end and a second radial end, the first radial end faces towards the outer hole end of transverse through hole of holder, the second radial end faces towards the inner hole end of transverse through hole of holder; a conically cylindrical space formed between the periphery of the second fixing part and the transverse through hole of holder, the conically cylindrical space, the second fixing part and the transverse through hole of holder are arranged concentrically, the conically cylindrical space has a space flaring end and a space tapering end, and the inside and outside diameters of one end between the transverse through hole and the second fixing part corresponding to the space tapering end are matched with each other; a low-melting metal material, filling the conically cylindrical space, the entity shape of low-melting metal material matches the shape of conically cylindrical space, forming a conically cylindrical entity with equal wall thickness.

The main effects and merits of the present invention are:

Firstly, the second fixing part of the hot melt safety door holder device and the transverse through hole of holder are easy to be arranged in concentrically normal position, so as to ensure the thickness of various lateral tube walls of the low-melting metal material filled between them is even, and the melting points of various lateral tube walls are relatively coincident, so as to implement the practical progressiveness of estimating the overall melting temperature of low-melting metal accurately, upgrading the quality and safety performance of hot melt safety door holder device effectively.

Secondly, for the morphological feature of the conically cylindrical space, when the low-melting metal material is molten by high temperature, as the path on which the second fixing part escapes from the transverse through hole of outer holder as the door sheet swings open is a curved path, and the conically cylindrical space exactly follows this path to avoid the second fixing part rubbing against the transverse through hole, the second fixing part can escape smoothly. Thus, under the morphological condition not to increase the wall thickness of low-melting metal, the technical features of the present invention result in a special practical progressiveness that the hot melt safety door holder device can release the swing door sheet smoothly in a fire, so as to implement the expected safety and disaster prevention effects of automatic closing.

DETAILED DESCRIPTION OF THE INVENTION

Figure 1:
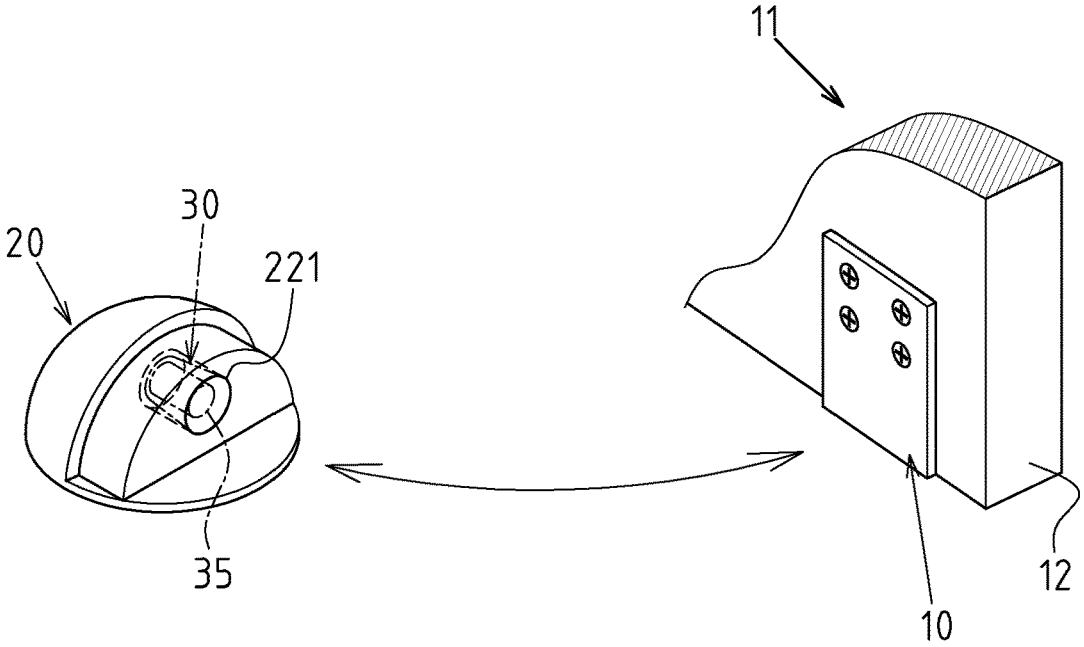
FIG. 1 is a stereogram of the preferred embodiment of the present invention.

Referring to FIGS. 1 to 4, there is shown the preferred embodiment of this hot melt safety door holder device. This embodiment is for illustration only, and the patent application is not limited to this structure.

Said hot melt safety door holder device comprises a first fixing part 10, located on one side of swing end 12 of a swing door sheet 11; a holder 20 with a mounting part 21 and a transverse through hole 22 located in different positions, the transverse through hole 22 has an outer hole end 221 and an inner hole end 222, wherein the outer hole end 221 faces towards the first fixing part 10; a second fixing part 30, located in the transverse through hole 22 of the holder 20, the second fixing part 30 has a first radial end 31 and a second radial end 32, the first radial end 31 faces towards the outer hole end 221 of the transverse through hole 22 of the holder 20, the second radial end 32 faces towards the inner hole end 222 of transverse through hole 22 of the holder 20; a conically cylindrical space 40, relatively formed between the periphery of the second fixing part 30 and the transverse through hole 22 of the holder 20, the conically cylindrical space 40, the second fixing part 30 and the transverse through hole 22 of the holder 20 are arranged concentrically, the conically cylindrical space 40 has a space flaring end 41 and a space tapering end 42, and the inside and outside diameters of one end between the transverse through hole 22 and the second fixing part 30 corresponding to the space tapering end 42 are fitted with each other (note: said fit relationship includes that with fit tolerance value, the positive-negative difference of the tolerance value is minimal, but excluding that making the second fixing part 30 escape from said concentric configuration state); a low-melting metal material 50, filled in the conically cylindrical space 40, so that the entity shape of the low-melting metal material 50 matches the shape of the conically cylindrical space 40 to present a conically cylindrical entity with equal wall thickness. The low-melting metal material 50 is any one of Bi, Sn, Pb, Cd and In metals or a fusible alloy composed of any combination of them.

Figure 2:
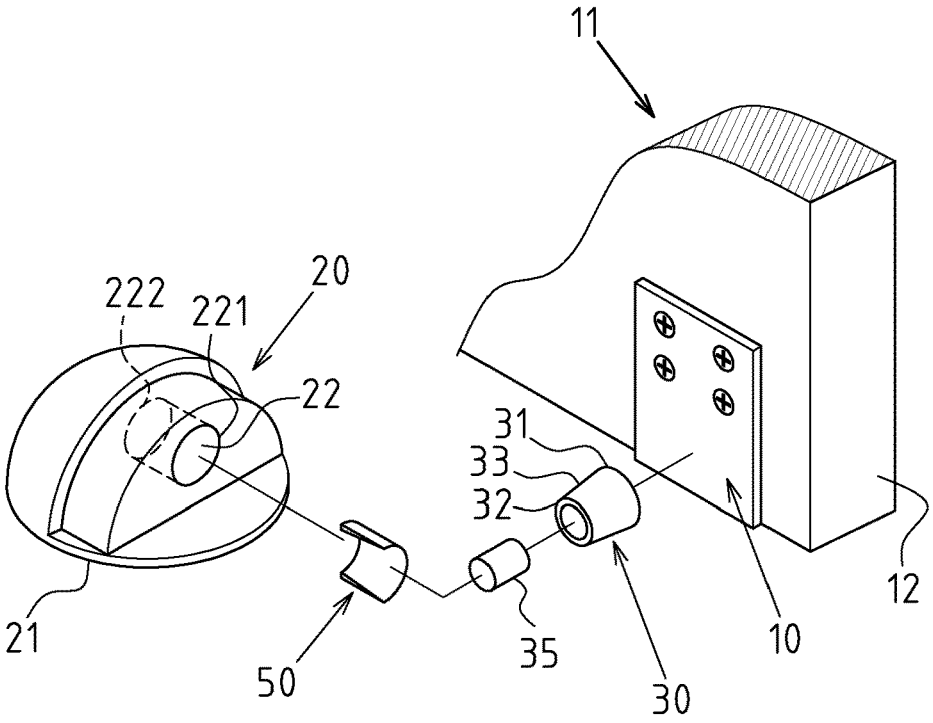
FIG. 2 is an exploded view of the preferred embodiment of this structure.

As shown in FIG. 2, in this case, the transverse through hole 22 in the holder 20 is a straight hole; the second fixing part 30 has a conically peripheral wall 33 between the first radial end 31 and the second radial end 32, the outside diameter of the first radial end 31 is larger than the outside diameter of the second radial end 32, forming the tapered shape of the conically peripheral wall 33 from the first radial end 31 to the second radial end 32, and the first radial end 31 faces towards the outer hole end 221 of the transverse through hole 22 in the holder 20, the second radial end 32 faces towards the inner hole end 222 of the transverse through hole 22, and the inside and outside diameters are fitted with each other between the first radial end 31 and the outer hole end 221, there is an annular spacing between the second radial end 32 and the inner hole end 222.

Figure 3:
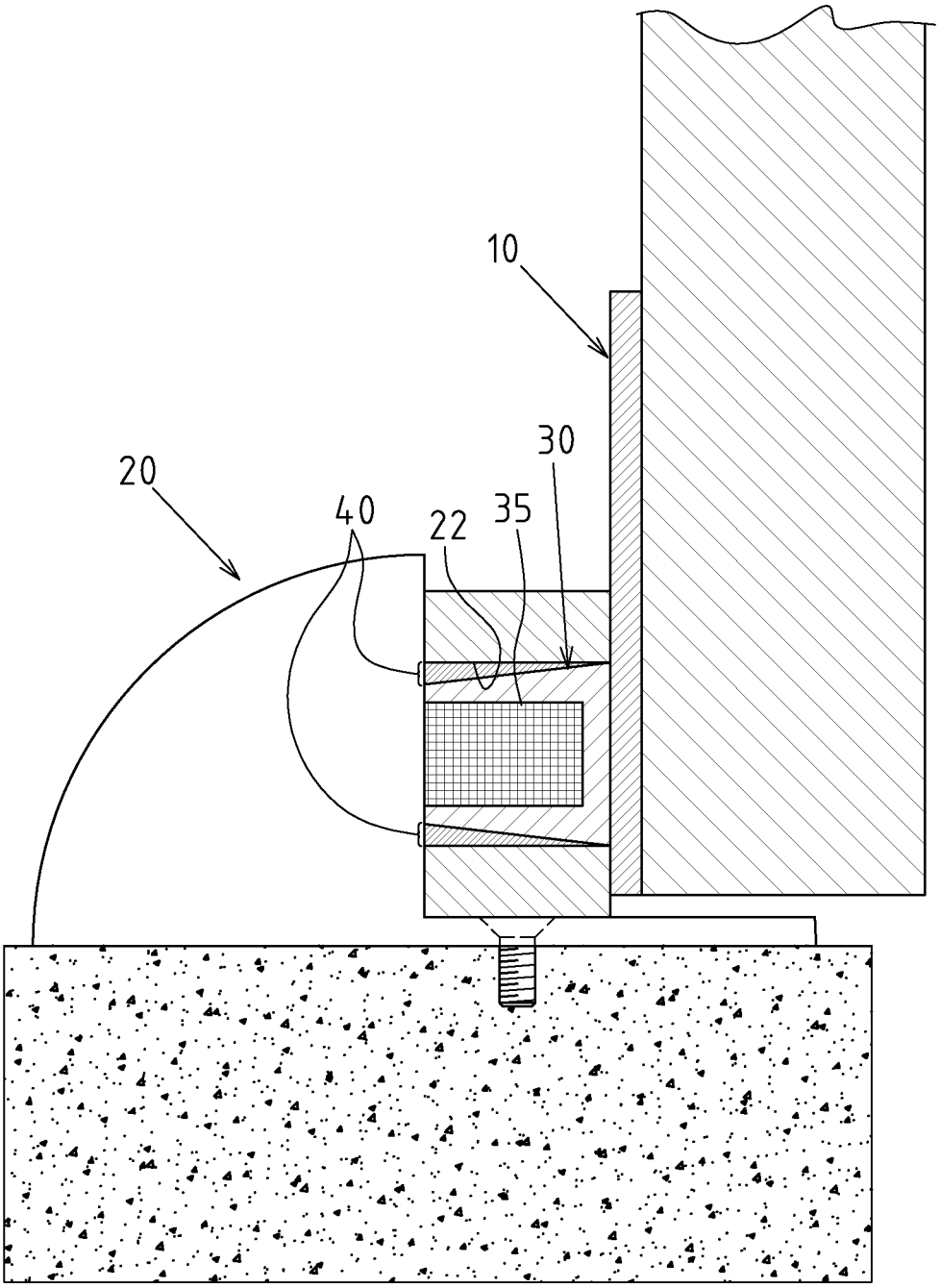
FIG. 3 is a sectional view of the preferred embodiment of the present invention.

As shown in FIGS. 1 to 3, in this case, the first fixing part 10 is a magnetizer, the second fixing part 30 is a metal block embedded with a magnet 35; this case describes the implementation pattern of positioning by magnetic attraction between the first fixing part 10 and the second fixing part 30.

Figure 4:
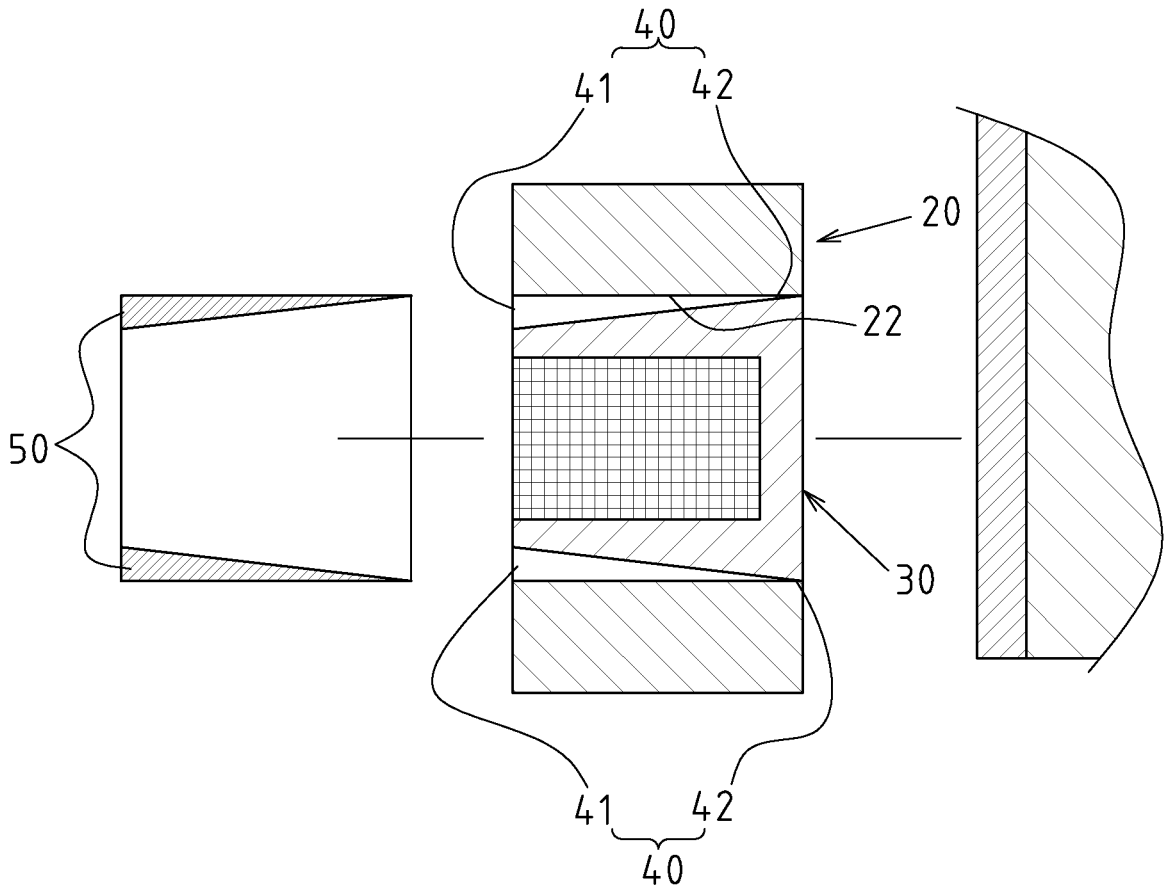
FIG. 4 is a sectional view of partial enlargement of transverse through hole of the present invention.

As shown in FIG. 4, in this case, the end faces are level with each other on the same end of fitted inside and outside diameters between the transverse through hole 22 and the second fixing part 30; this case is a preferred implementation pattern, reasonably, it is easier to implement the fitted inside and outside diameters between transverse through hole 22 and the second fixing part 30.

Figure 5:
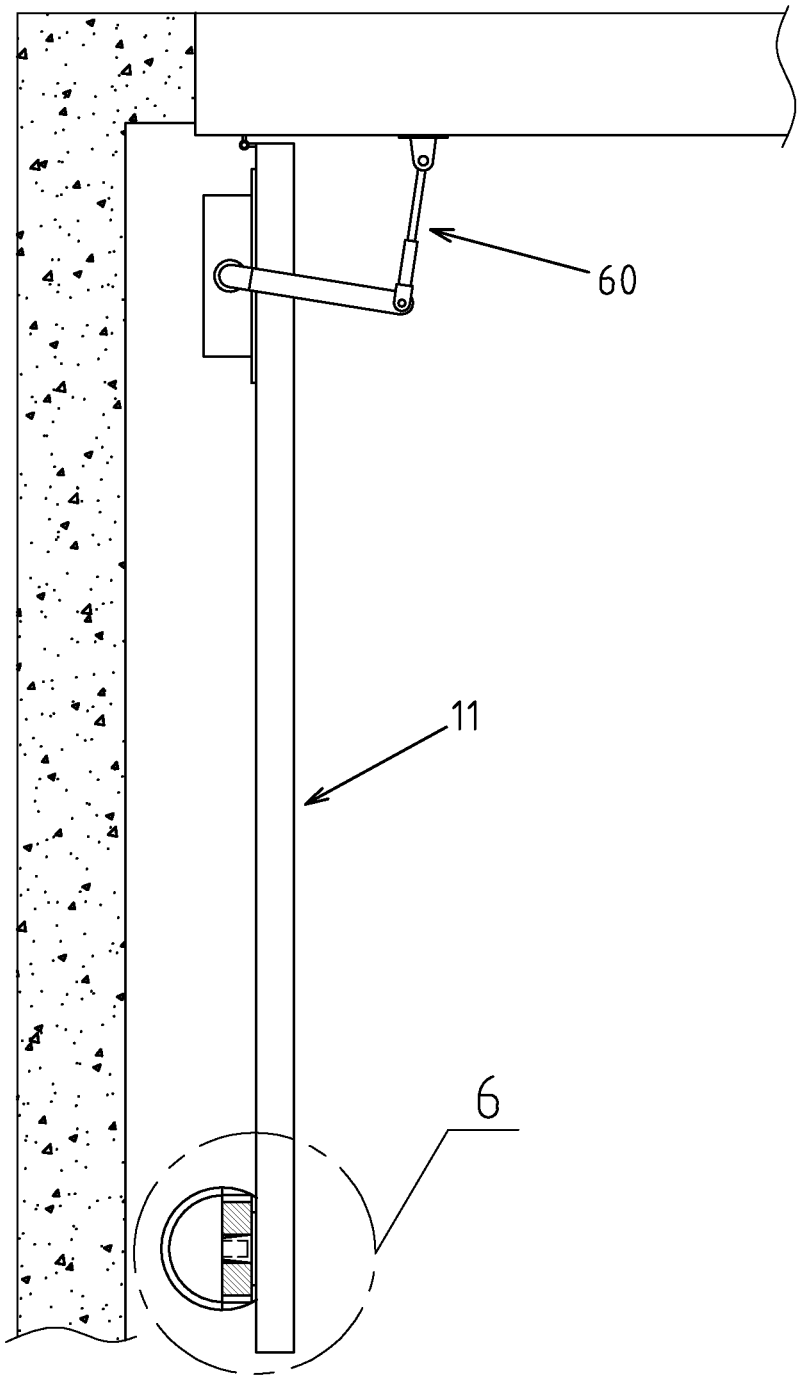
FIG. 5 is a schematic diagram of locating the second fixing part of the present invention in the transverse through hole of holder.
Figure 6:
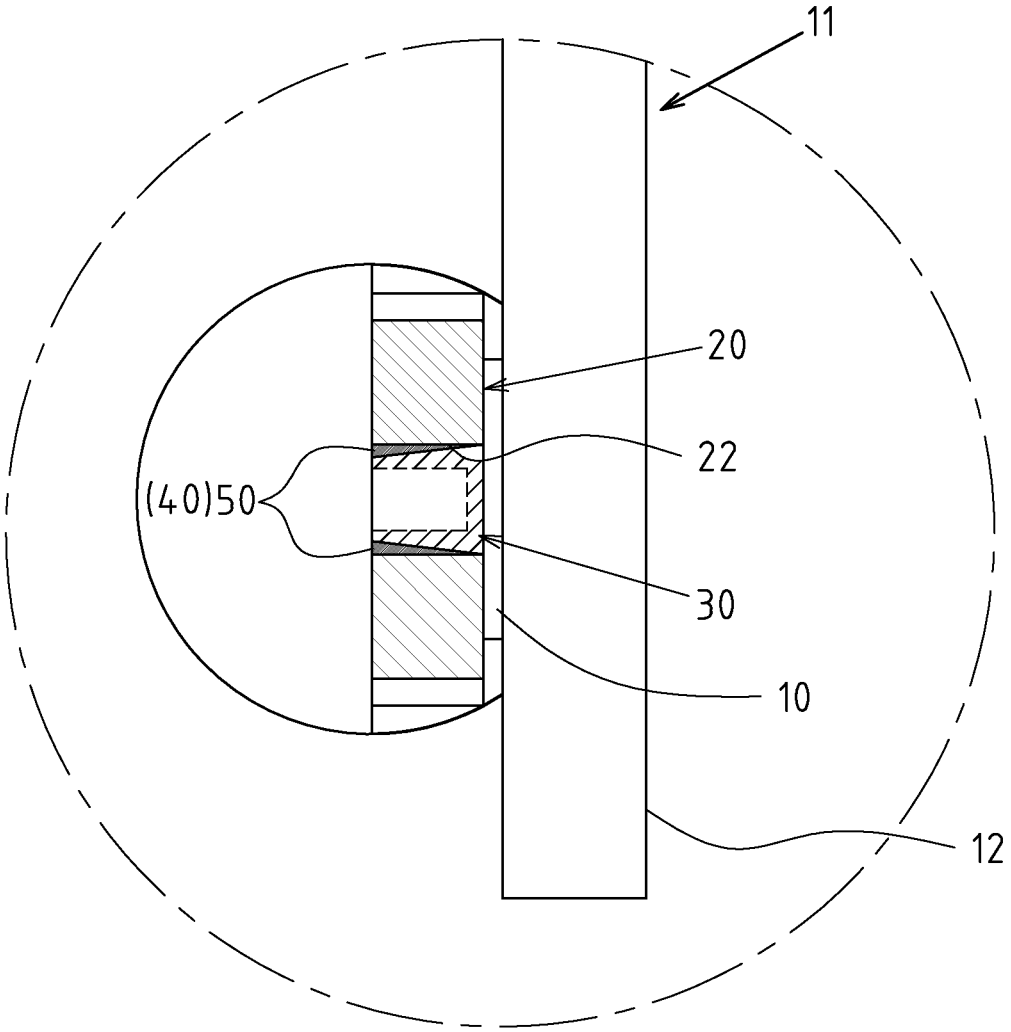
FIG. 6 is a close-up view of FIG. 5.
Figure 7:
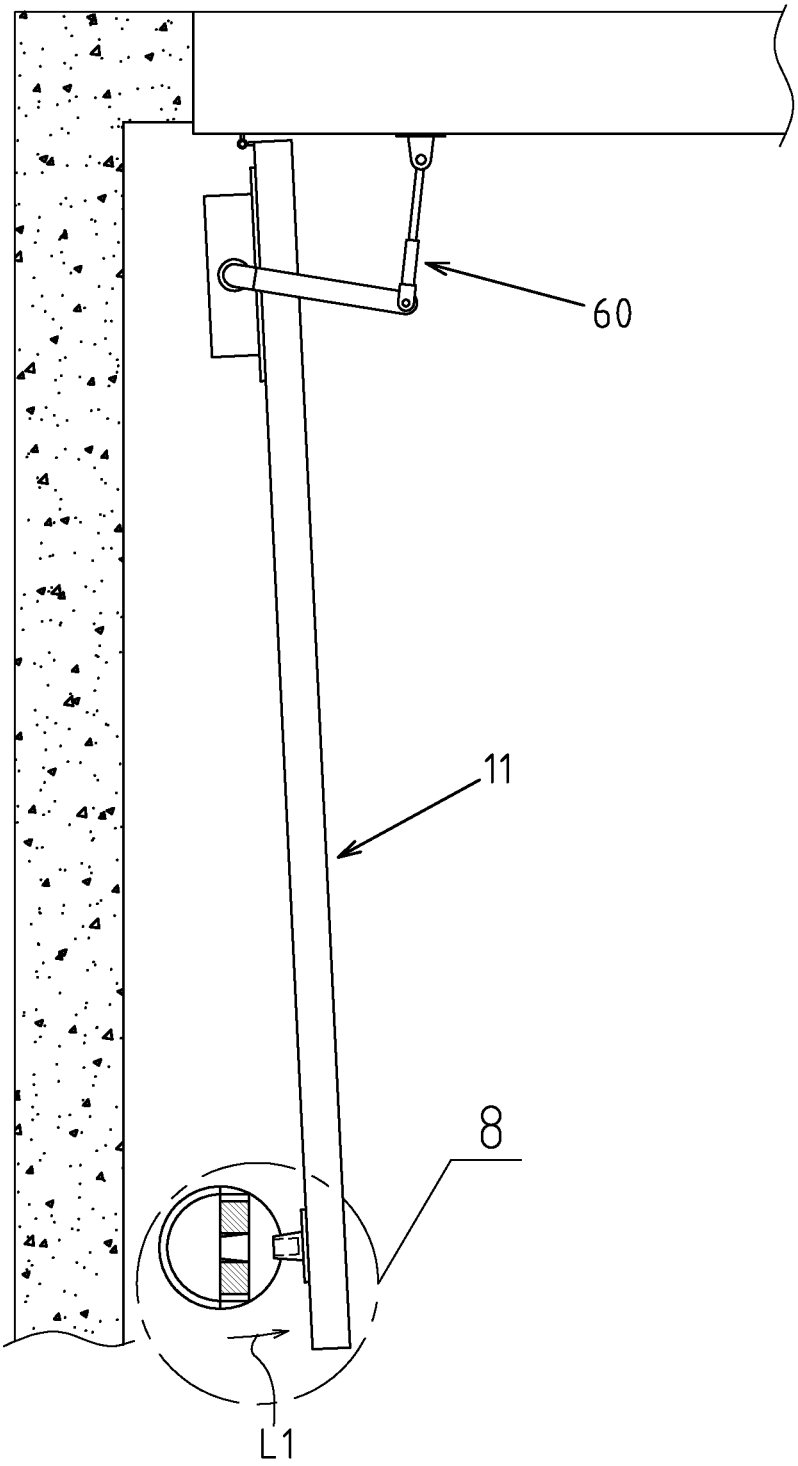
FIG. 7 is a schematic diagram of the second fixing part of the present invention escaping from the transverse through hole of holder.
Figure 8:
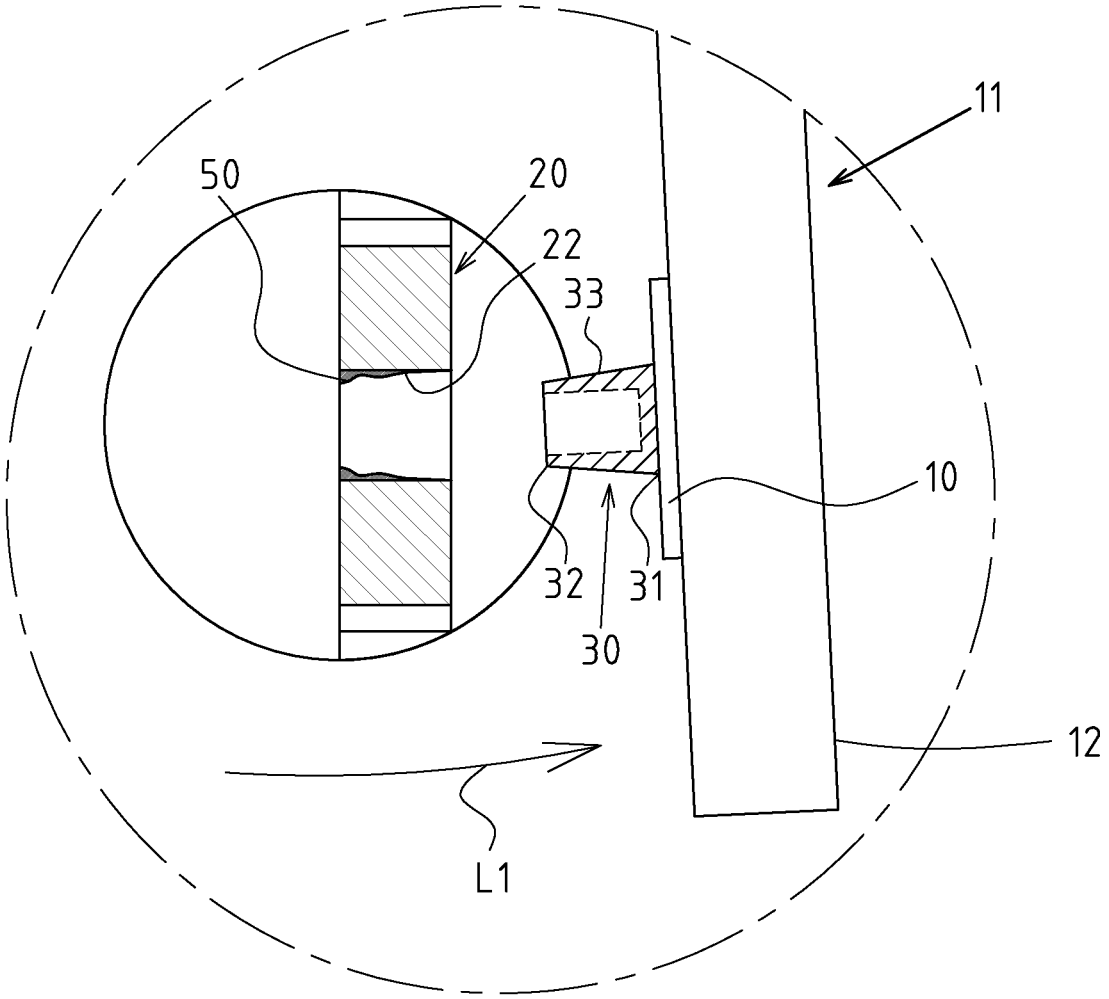
FIG. 8 is a close-up view of FIG. 7.

By said structural composition pattern and technical characteristics, in terms of said preferred embodiment of specific application of the hot melt safety door holder device disclosed in the present invention, as shown in FIGS. 5 and 6, the swing door sheet 11 is at an open angle and snapped by the hot melt safety door holder device. In this state, the door closer 60 for the swing door sheet 11 accumulates reset force, the first fixing part 10 of hot melt safety door holder device mounted on one side of swing end 12 of swing door sheet 11 and the second fixing part 30 are located by magnetic attraction, the second fixing part 30 and the transverse through hole 22 in the holder 20 are combined by the low-melting metal material 50 filled in the conically cylindrical space 40. In general circumstances, if the user applies a force to close the swing door sheet 11, the first fixing part 10 is disengaged from the second fixing part 30. Afterwards, as shown in FIGS. 7 and 8, when a fire occurs and the ambient temperature rises to a certain level (e.g. 45° C.), the low-melting metal material 50 melts, the bonding state between the second fixing part 30 and the transverse through hole 22 in the holder 20 is lost, the swing door sheet 11 is relatively released, the reset force accumulated by the door closer 60 pushes the swing door sheet 11 to swing towards the closing direction (see Arrow L1), and the second fixing part 30 is led out by the first fixing part 10 (for magnetic attraction), so as to escape from the transverse through hole 22 in the holder 20. When the second fixing part 30 is escaping, as the conically peripheral wall 33 tapers from the first radial end 31 to the second radial end 32, when the second fixing part 30 escapes on a curved path with the first fixing part 10, the conically peripheral wall 33 can completely avoid rubbing against the transverse through hole 22 with straight hole wall, so that the second fixing part 30 can escape smoothly.

Figure 9:
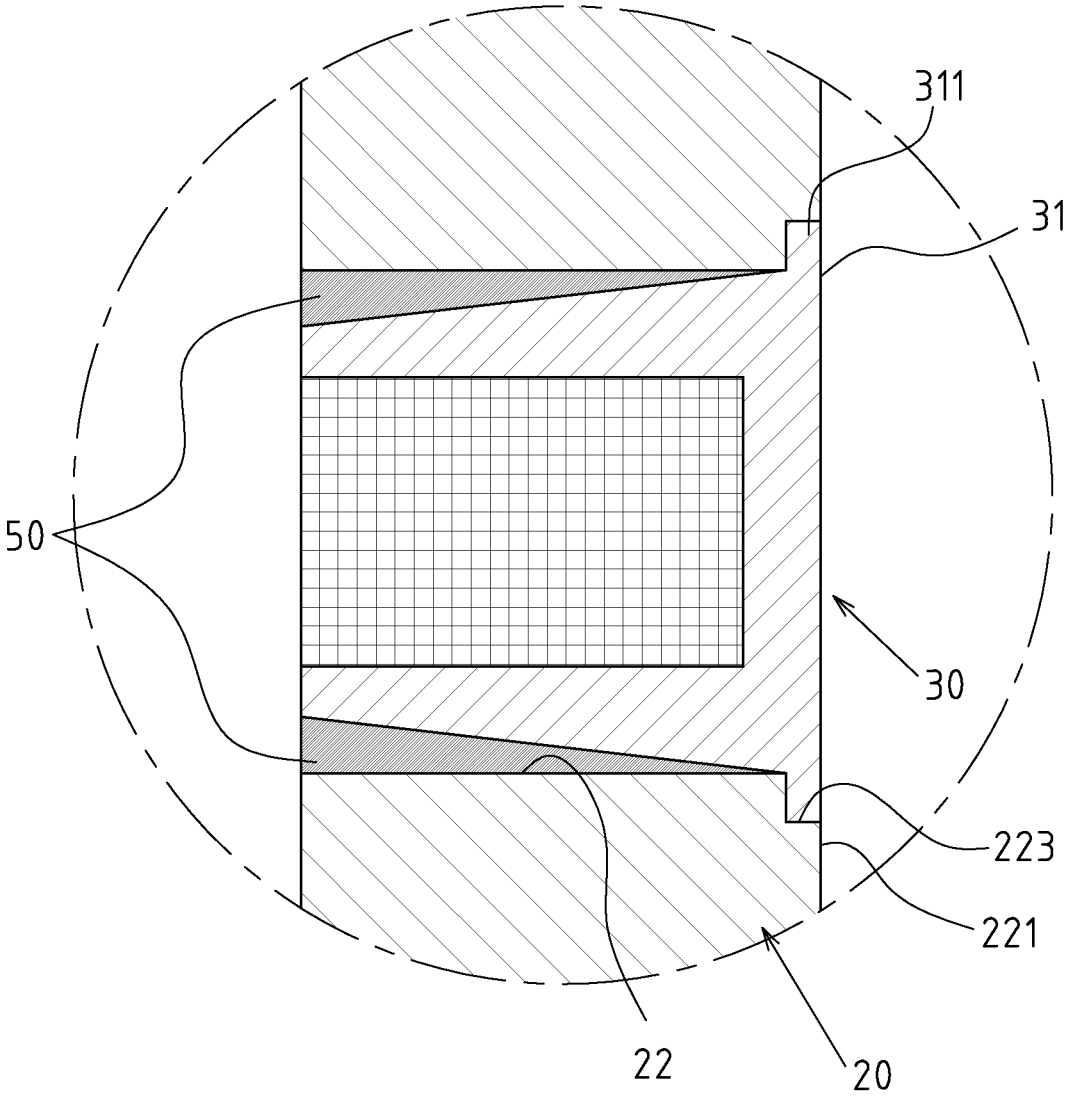
FIG. 9 shows the embodiment where a ring flange is formed around the first radial end of the second fixing part of the present invention.

As shown in FIG. 9, in this case, a ring flange 311 is formed around the first radial end 31 of the second fixing part 30, and the outer hole end 221 of the transverse through hole 22 in the holder 20 is provided with an annular shoulder 223 for the ring flange 311 to be embedded. This implementation pattern describes that as the low-melting metal material 50 is formed by filling, if there is a large gap in one end of fitted inside and outside diameters between the transverse through hole 22 and the second fixing part 30, the low-melting metal material 50 may spill over, influencing the forming quality. Therefore, the ring flange 311 disclosed in this case can stop the low-melting metal material 50 filled in the conically cylindrical space 40, so as to avoid said problem effectively.

Figure 10:
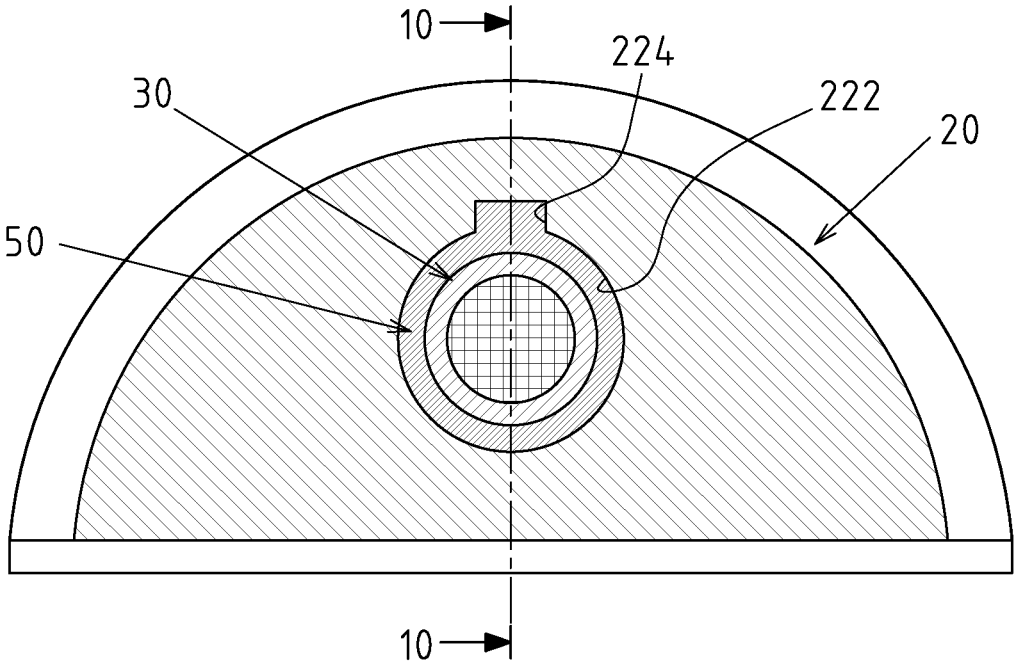
FIG. 10 shows the embodiment where partial hole wall of inner hole end of the transverse through hole in the holder of the present invention extends outwards to expand the filling notch.
Figure 11:
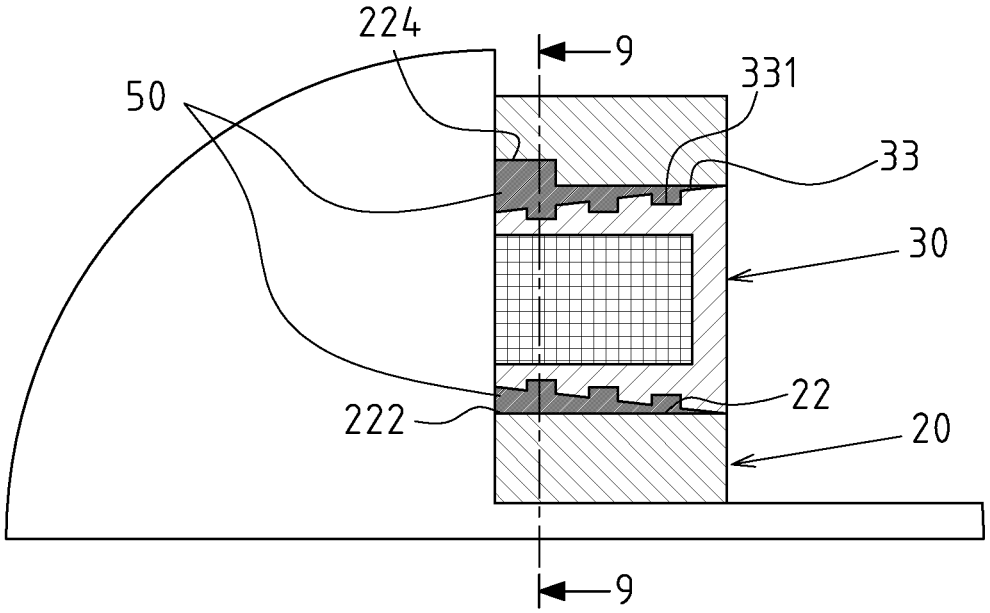
FIG. 11 is a sectional view of FIG. 10.

As shown in FIGS. 10 and 11, in this case, partial hole wall of inner hole end 222 of transverse through hole 22 in the holder 20 extends outwards to form an expanded filling notch 224. Said expanded filling notch 224 is added in this case, because the space flaring end 41 of the conically cylindrical space 40 may have too small gap, resulting in difficult filling of low-melting metal material 50. Therefore, the expanded filling notch 224 can enlarge the filling area, so as to enhance the convenience of filling operation.

As shown in FIG. 11, in this case, the conically peripheral wall 33 of the second fixing part 30 is provided with at least one radial concave part 331 for partial area of the low-melting metal material 50 to be filled in. Said radial concave part 331 in this case can enlarge the contact area of the formed low-melting metal material 50 embedded in the second fixing part 30, so as to further tighten the bonding state between the low-melting metal material 50 and the second fixing part 30, the stressing strength is better, to prevent them from being separated.

Figure 12:
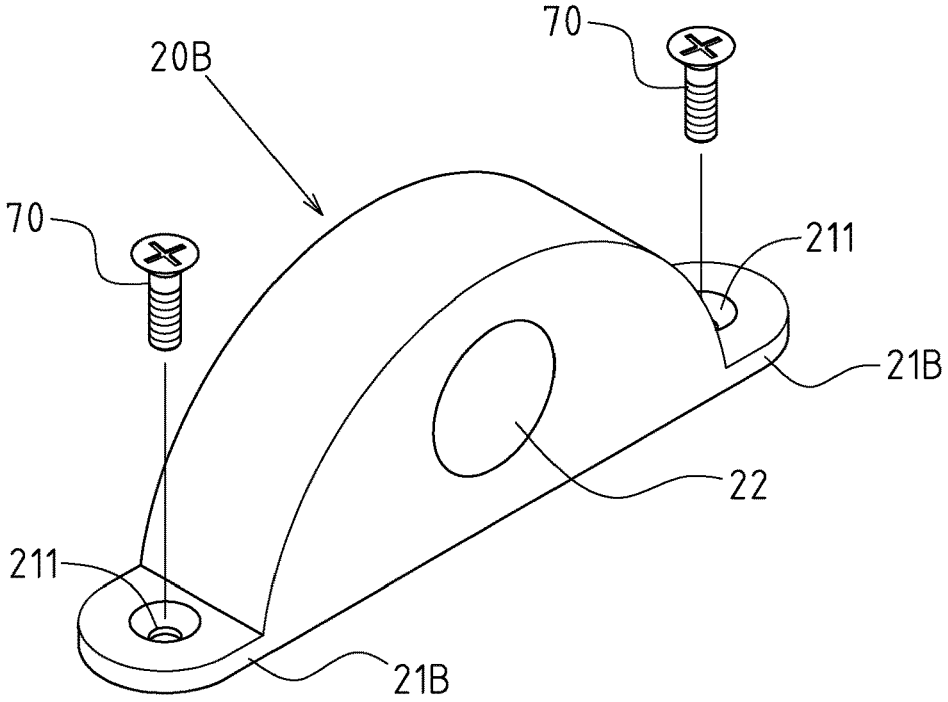
FIG. 12 shows the embodiment of simple holder structure of the present invention.

FIG. 12 shows another embodiment of the mounting part 21B of the holder 20B. The mounting parts 21B disclosed in this case are lugs protruding on both sides of the holder 20B, each of them is provided with a locking hole 211, fastened to the floor by screw 70.

Figure 13:
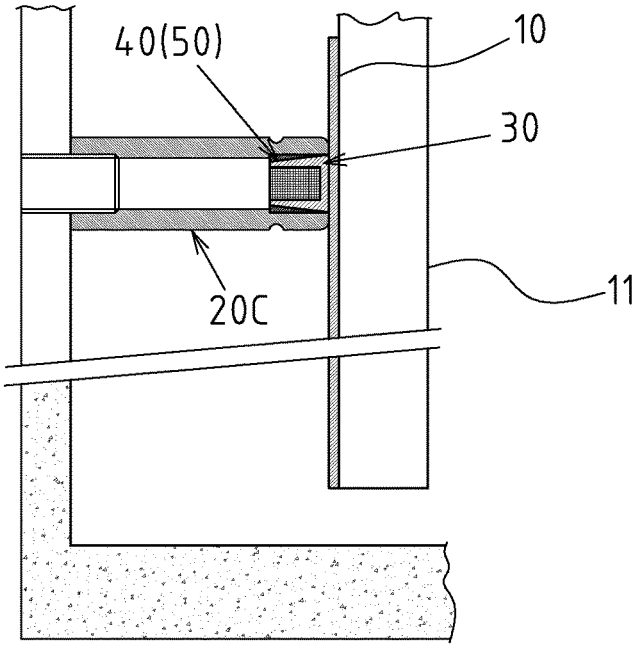
FIG. 13 shows the embodiment of the wall-mounted holder of the present invention.

FIG. 13 shows the embodiment of the holder 20C designed as wall-mounted type, the wall-mounted holder 20C disclosed in this case has higher mounting position, the larger height has higher temperature in a fire, so the low-melting metal material 50 is easy to be molten by high temperature, the action sensitivity is better.

Figure 14:
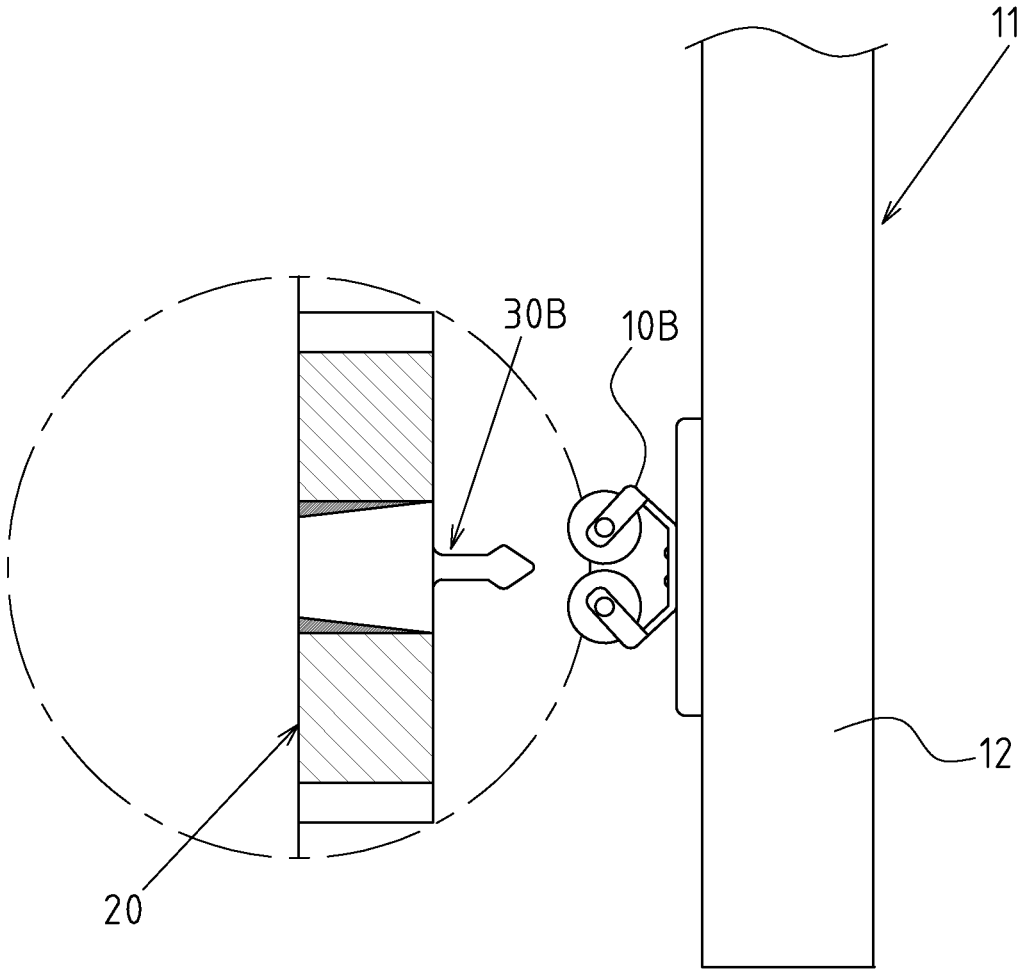
FIG. 14 shows the embodiment where the first and second fixing parts of the present invention are designed as male and female fasteners.

As shown in FIG. 14, the first fixing part 10B and the second fixing part 30B disclosed in this case are designed as male and female fasteners, this is a specific fixing pattern.

Figure 15:
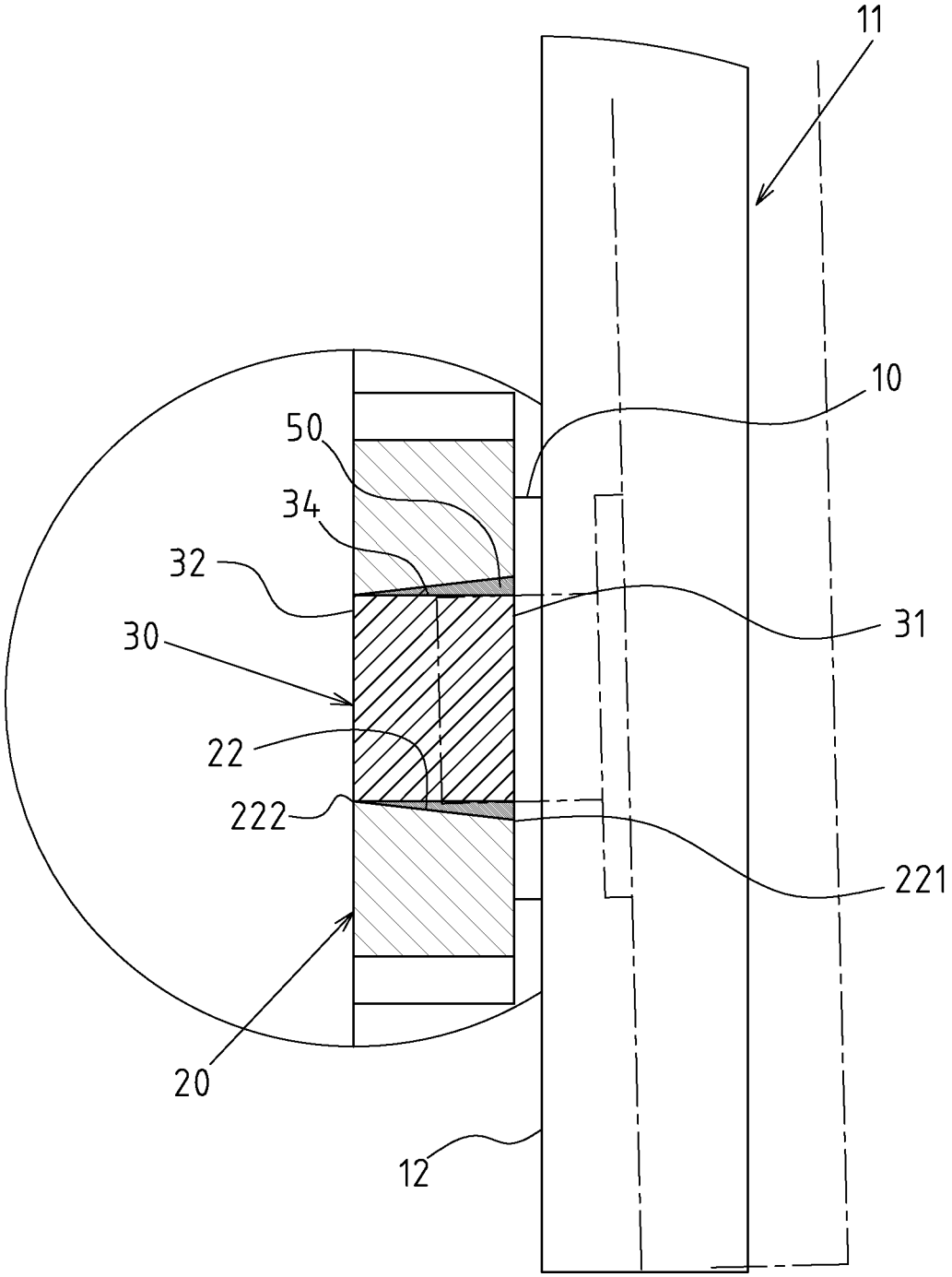
FIG. 15 shows the embodiment where the second fixing part of the present invention is designed as straight tubular peripheral wall.

As shown in FIG. 15, in this case, there is a straight tubular peripheral wall 34 between the first radial end 31 and the second radial end 32 of the second fixing part 30; the outside diameter of the outer hole end 221 of the transverse through hole 22 in the holder 20 is larger than the outside diameter of the inner hole end 222, so that the transverse through hole 22 tapers from the outer hole end 221 to the inner hole end 222, and the inside and outside diameters are fitted with each other between the inner hole end 222 of the transverse through hole 22 and the second radial end 32 of the second fixing part 30, and there is an annular spacing between the outer hole end 221 of the transverse through hole 22 and the first radial end 31 of the second fixing part 30. This case describes that the wall thickness increasing direction of the low-melting metal material 50 can implement the equal effect of the implementation pattern of different ends disclosed in FIG. 4.

I claim:

1. A hot melt safety door holder device comprising:

a first fixing part adapted to be mounted on one side of a swing end of a swing door sheet, wherein said first fixing part is magnetic;

a holder having a mounting part and a transverse through hole located in different positions, wherein the transverse through hole has an outer hole end and an inner hole end, the outer hole end facing said first fixing part;

a second fixing part located in the transverse through hole of said holder, said second fixing part having a first radial end and a second radial end, the first radial end facing the outer hole end of the transverse through hole in said holder, the second radial end facing the inner hole end of the transverse through hole in said holder, said second fixing part being composed of a magnetic absorption part;

a conically cylindrical space formed between a periphery of said second fixing part and the transverse through hole in said holder, wherein said conically cylindrical space and said second fixing part and the transverse through hole are arranged concentrically, said conically cylindrical space having a space flaring end and a space tapering end, wherein an inner diameter and an outer diameter of said conically cylindrical space between the transverse through hole and said second fixing part corresponding to the space tapering end are fitted with each other; and a low-melting point metal material filled in said conically cylindrical space so as to be formed into a conically cylindrical entity that matches a shape of said conically cylindrical space, wherein said second fixing part is positioned on said holder by said low-melting point metal material such that said second fixing part magnetically receives said first fixing part and the swing door, wherein said low-melting point metal material has a consistent melting point through a thickness thereof, said low-melting point metal material adapted to melt upon encountering a fire so as to cause said second fixing part and said first fixing part and the swing door to separate from said holder.

2. The hot melt safety door holder device of claim 1, wherein the transverse through hole in said holder has a straight hole wall, said second fixing part having a conically peripheral wall between the first radial end and the second radial end, an outer diameter of the first radial end being greater than an outer diameter of the second radial end such that the conically peripheral wall tapers from the first radial end to the second radial end, the first radial end facing the outer hole end of the transverse through hole in said holder, the second radial end facing the inner hole end of the transverse through hole, wherein an annular space is formed between the second radial end and the inner hole end of the transverse through hole.

3. The hot melt safety door holder device of claim 1, wherein a straight tubular peripheral wall is formed between the first radial end and the second radial end of said second fixing part, an outer diameter of the outer hole end of the transverse through hole in said holder is larger than an outer diameter of the inner hole end such that the transverse through hole tapers from the outer hole end to the inner hole end, wherein an annular spacing is formed between the outer hole end of the transverse through hole and the first radial end of said first fixing part.

4. The hot melt safety door holder device of claim 2, wherein a ring flange is formed around the first radial end of said second fixing part, the outer hole end of the transverse through hole in said holder has an annular shoulder, the ring flange being embedded in the annular shoulder.

5. The hot melt safety door holder device of claim 2, wherein the conically peripheral wall of said second fixing part has at least one radial concave part partially filling an area of said low-melting point metal material.

6. The hot melt safety door holder device of claim 3, wherein the conically peripheral wall of said second fixing part has at least one radial concave part partially filling an area of said low-melting point metal material.

7. The hot melt safety door holder device of claim 2, wherein a portion of the inner hole end of the transverse through hole in said holder extends outwardly to form an expanded filling notch.

8. The hot melt safety door holder device of claim 3, wherein a portion of the inner hole end of the transverse through hole in said holder extends outwardly to form an expanded filling notch.

9. The hot melt safety door holder device of claim 1, wherein said low-melting point metal material is a metal selected from the group consisting of bismuth, tin, lead, cadmium, indium and combinations thereof.

* * * * *